United States Patent [19]

Godet

[11] 3,987,452

[45] Oct. 19, 1976

[54] TRACKING ANTENNA MOUNT WITH COMPLETE HEMISPHERICAL COVERAGE

[75] Inventor: Sidney Godet, Little Falls, N.J.

[73] Assignee: International Telephone and Telegraph Corporation, Nutley, N.J.

[22] Filed: Dec. 9, 1975

[21] Appl. No.: 639,027

[52] U.S. Cl. ..... 343/765; 343/757

[51] Int. Cl.[2] ..... H01Q 3/00

[58] Field of Search ..... 343/765, 757

[56] References Cited

UNITED STATES PATENTS

| | | | |
|---|---|---|---|
| 2,556,026 | 6/1951 | Carlisle | 343/765 |
| 2,899,677 | 8/1959 | Rockall | 343/765 |

*Primary Examiner*—Harold A. Dixon

*Attorney, Agent, or Firm*—John T. O'Halloran; Alfred C. Hill

[57] ABSTRACT

A first column is secured to and extends vertically upward from a base. The first column has a first socket on the end thereof remote from the base. An intermediate member having first and second balls extending therefrom in opposite directions along a common axis is disposed to have the first ball rotatably engage the first socket. A second column having a second socket on one end thereof is disposed so that the second ball rotatably engages the second socket. An antenna structure is secured to the other end of the second column. A drive arrangement including a plurality of perforated tapes coupled in a predetermined manner to the intermediate member, the base, the first and second columns and the antenna structure provides the complete hemispherical coverage by the antenna structure.

11 Claims, 9 Drawing Figures

TRACKING ANTENNA MOUNT WITH COMPLETE HEMISPHERICAL COVERAGE

BACKGROUND OF THE INVENTION

This invention relates to antenna mounts and more particularly to tracking antenna mounts capable of providing angular motion for an antenna structure.

Tracking antenna mounts in general provide for angular motion of an antenna structure (dish, horn, lens phased arrays, etc.), such that the antenna can receive or transmit signals in a continuously selectable direction with respect to the base structure to which the antenna mount is secured.

Most existing tracking antenna mounts are gimbaled structures such that successive gimbals are rotated by some angle with respect to the adjacent gimbal. A tracking antenna mount is characterized by the number of such rotations, and is usually either 2-axis or 3-axis.

2-axis antenna mounts in general usage are: (1) AZ-EL, where the outer axis is the azimuth axis and is in a vertical direction with respect to the base structure and the inner axis is the elevation axis and is in a horizontal plane; (2) X–Y, where the outer axis is the X-axis and is in a fixed horizontal direction with respect to the base structure and the inner axis is the Y-axis and is in a plane normal to the X-axis; and (3) HA-DECL, where the outer axis is the hour angle axis and is parallel to the Earth's polar axis and the inner axis is the declination axis and is in the equatorial plane.

All of the 2-axis mounts enumerated above have a pole or discontinuity in the direction of the outer axis. Severe limitations on tracking (motion of the antenna axis) exist in the vicinity of the pole.

3-axis antenna mounts in general usage are: (1) Traverse/Elevation/Azimuth; and (2) Elevation/Cross-Level/Azimuth. 3-axis antenna mounts avoid the difficulties around the pole which are experienced in 2-axis antenna mounts.

Another class of antenna mounts is the non-gimbaled variety, which may utilize linear actuators, ball joints, etc.

The disadvantages of the above-mentioned antenna mounts is that the 2-axis gimbaled antenna mount must always restrict or exclude operation near the pole or discontinuity direction. The 3-axis gimbaled antenna mount does not have a pole, but is more complex, and consequently more expensive and less reliable than the 2-axis antenna mount. Also, for the 3-axis gimbaled antenna mount the tracking control circuitry becomes more complex because of the redundant third axis. Existing non-gimbaled antenna mounts generally operate over a restricted coverage angle which is considerably less than a hemisphere.

SUMMARY OF THE INVENTION

An object of the present invention is to provide a tracking antenna mount which overcomes the above-mentioned disadvantages.

Another object of the present invention is to provide a tracking antenna mount that has no pole, or discontinuity in the upper hemisphere thereby avoiding the limitations of the 2-axis antenna mounts.

Still another object of the present invention is to provide a tracking antenna mount that employs only two servo drive mechanisms thereby avoiding the complexities of the 3-axis antenna mount.

A further object of the present invention is to provide a compound (2 ball joint), non-gimbaled tracking antenna mount where, for complete hemispherical coverage, each element is required to move only 45° from its normal position thereby avoiding the restricted angular coverage limitations inherent in existing non-gimbaled antenena mounts.

A feature of the present invention is the provision of a tracking antenna mount with complete hemispherical coverage comprising: a base; a first column secured to and extending vertically upward from the base, the first column having a first socket on an end thereof remote from said base; an intermediate structure having first and second balls extending therefrom in opposite directions along a common axis, the first ball rotatably engaging the first socket; a second column having a second socket on one end thereof, the second ball rotatably engaging the second socket; an antenna structure secured to the other end of the second column; and drive means coupled to the intermediate member, the base, the first and second columns and the antenna structure to provide the complete hemispherical coverage by the antenna structure.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
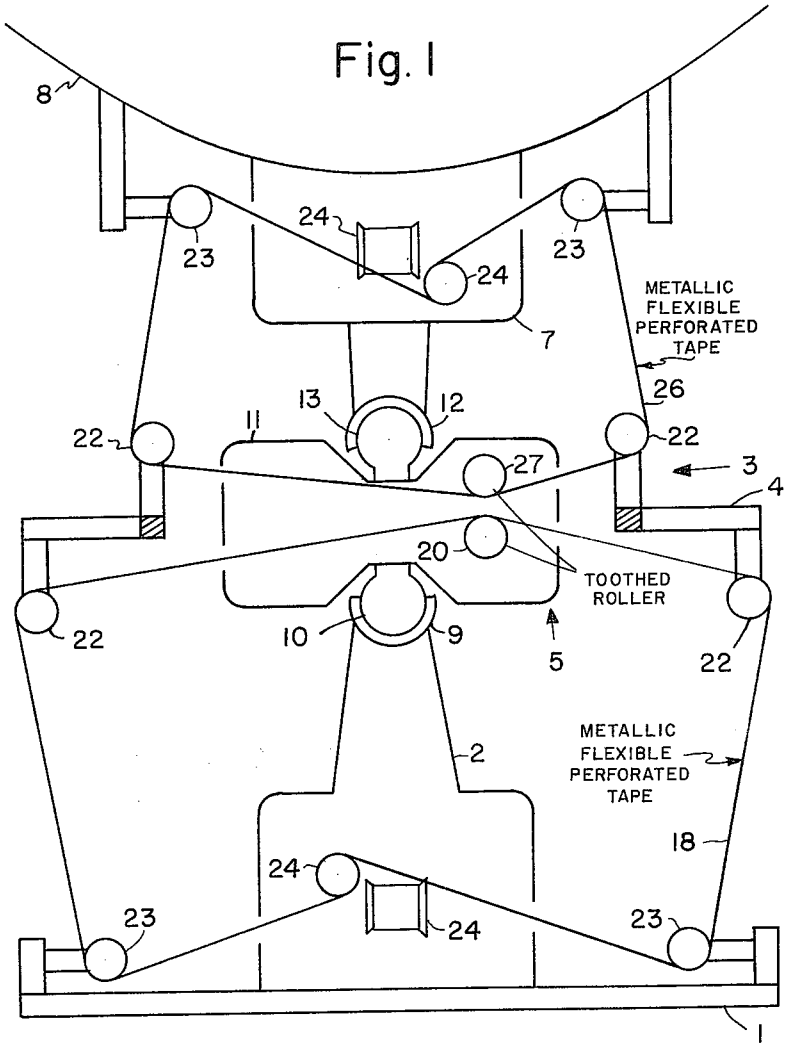
FIG. 1 is a schematic elevational view of the tracking antenna mount in accordance with the principles of the present invention with the antenna structure at a 90° elevation angle.
Figure 2:
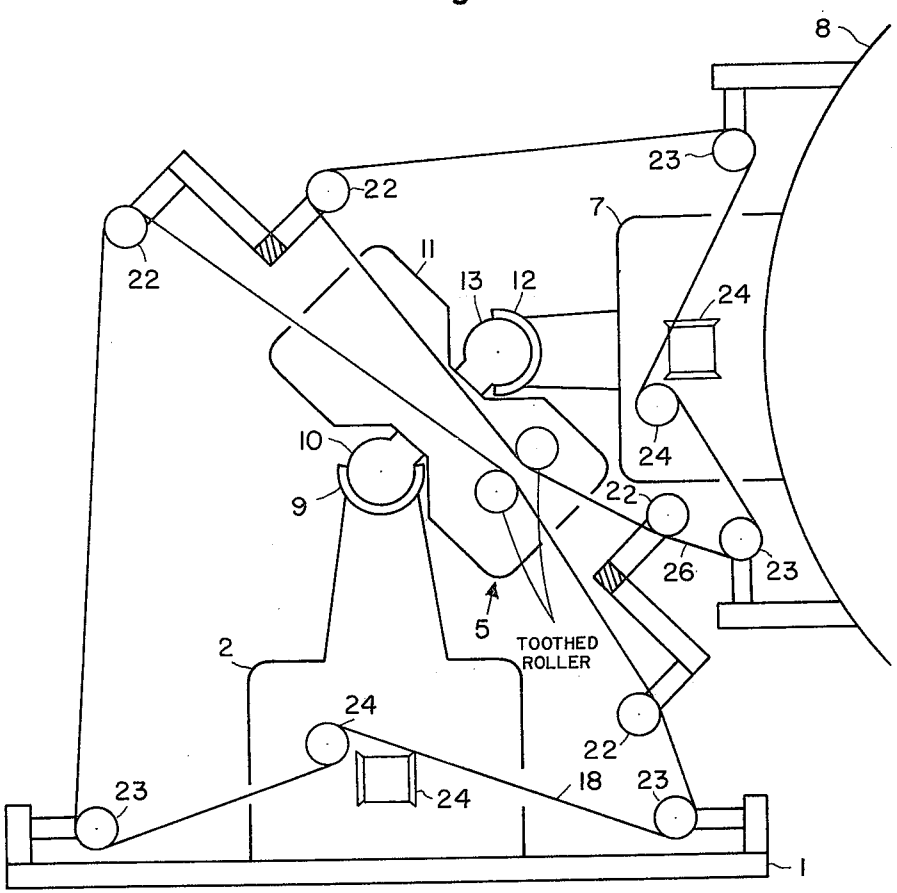
FIG. 2 is a schematic elevational view of the tracking antenna mount of FIG. 1 with the antenna structure at a 0° elevation angle.

It should be noted that FIGS. 1 and 2 illustrate a schematic elevational view of the tracking antenna mount of the present invention in one plane which is identical to the schematic elevational view of the tracking antenna mount of the present invention in a plane oriented 90° with respect to the illustrated plane.

Figure 3:
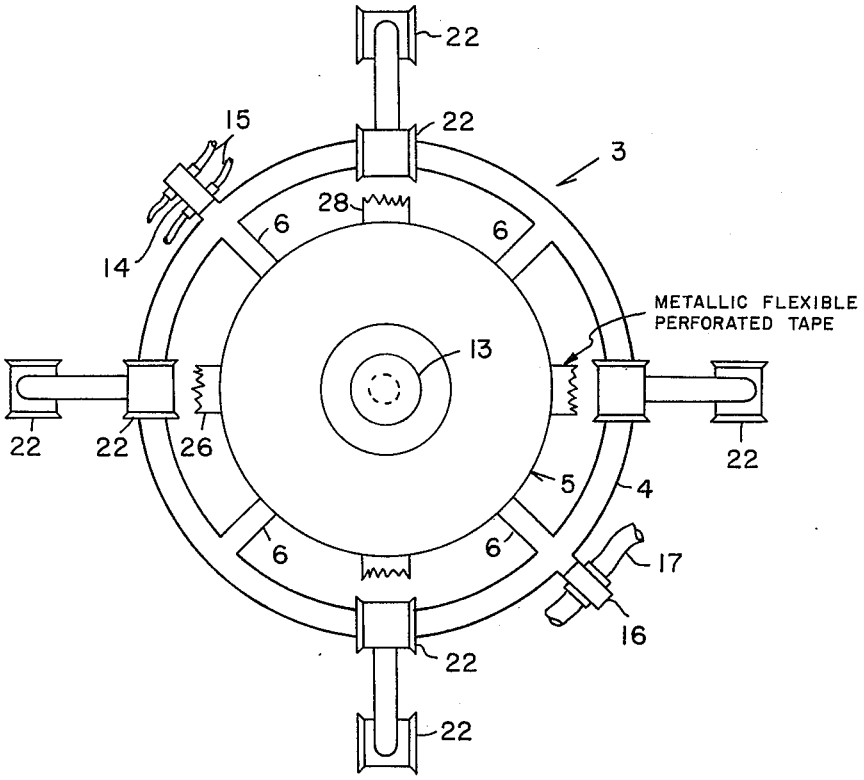
FIG. 3 is a top plan view of the intermediate member and drive mechanism of FIGS. 1 and 2.

Referring to FIGS. 1, 2 and 3 the tracking antenna mount of the present invention includes the following basic components, a base 1, a column 2 secured to and extending vertically from base 1, an intermediate structure 3 including intermediate member 4 and drive mechanism 5 secured to member 4 by members 6, and a column 7 supporting the antenna structure 8 illustrated, for example, to be a reflecting dish, but which could be a horn, lens, phase array or the like. Column 2 includes a socket 9 which rotatably engages a ball 10 extending from the housing 11 of mechanism 5 and column 7 includes a socket 12 which rotatably engages a ball 13 extending from housing 11 of mechanism 5 along an axis common to balls 10 and 13.

Intermediate member 4 includes an anchor 14 for flexible cables 15 extending from base 1 to antenna structure 8 and an anchor 16 for flexible waveguide 17 also extending from base 1 to antenna structure 8. Anchors 14 and 16 prevent tangling and snarling of cables 15 and waveguide 17 during the motion of the antenna mount.

Figure 5:
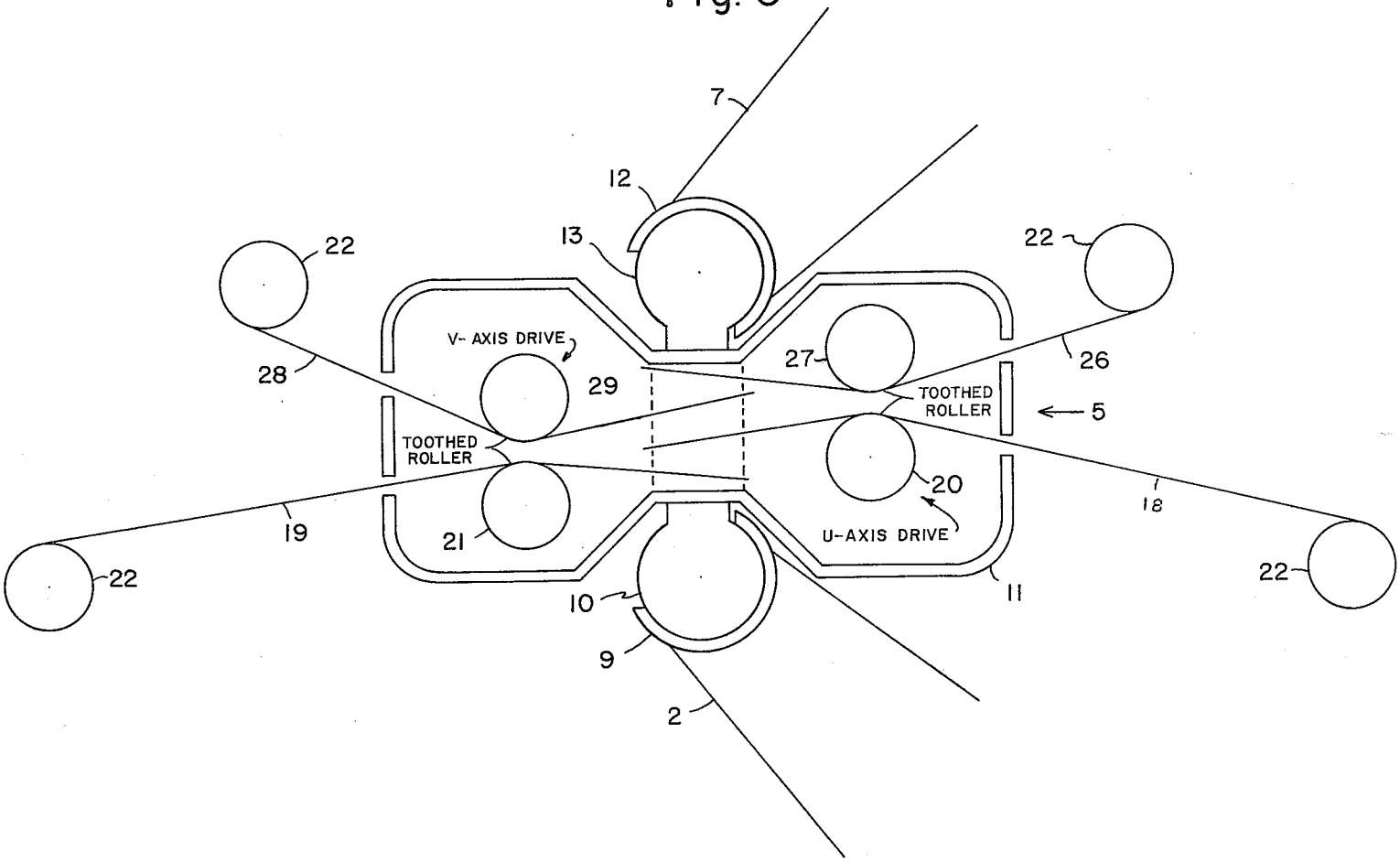
FIG. 5 is a cross-sectional view of the drive mechanism of FIGS. 1 and 2 with the left hand side rotated 90° about the axis of symmetry (thru the ball centers) with respect to the right hand side to show the perforated tape clearance in the central area.

Motion between intermediate structure 3 and column 2 is controlled by means of two metal flexible perforated tapes 18 and 19. Tape 18 is in the plane of FIGS. 1 and 2 while tape 19 is in a plane oriented at 90° with relation to the plane of FIG. 1 as shown in FIG. 3. By means of the motion of tapes 18 and 19, the axis of intermediate structure 3 can be displaced from the axis of column 2 by an amount in excess of 45° in any direction. Tape 18 is driven by a toothed roller 20 in drive mechanism 5. Tape 19 is driven by a toothed roller 21 as illustrated in FIG. 5 where the left hand side is rotated 90° about the axis of symmetry (thru the ball centers) with respect to the right hand side. This illustration of FIG. 5 is primarily to show the perforated tape clearance in the center area of drive mechanism 5.

Figure 9:
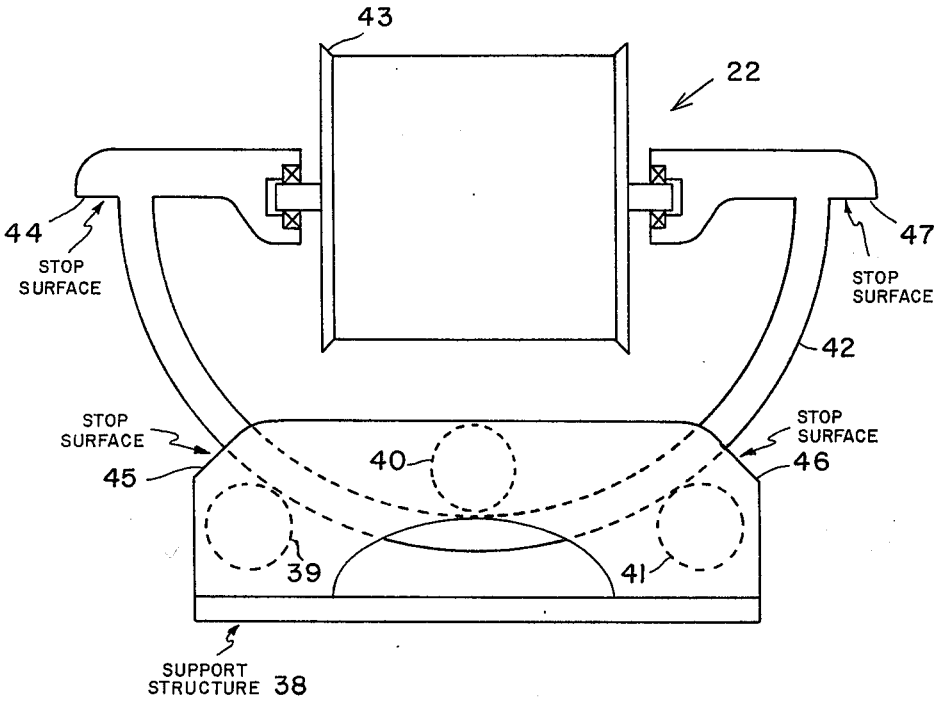
FIG. 9 is a detailed front view of tape rollers 22 of FIGS. 1 and 2.
Figure 8:
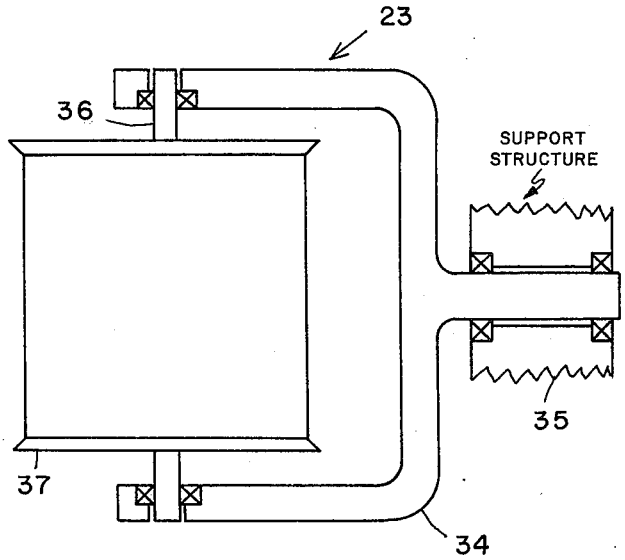
FIG. 8 is a detailed front view of tape rollers 23 of FIGS. 1 and 2.

The two drives are designated as U-axis and V-axis drive. Tape rollers 22 on intermediate member 4 and tape rollers 23 on base 1, acting in conjunction with the ball joint including socket 9 and ball 10 serve to convert the U-axis and V-axis drive motions to an angular displacement between column 2 and intermediate structure 3. Sufficient degrees of freedom are provided on the tape rollers 22 and 23 so that the tape makes full contact across the roller as illustrated in FIGS. 8 and 9.

Figure 4:
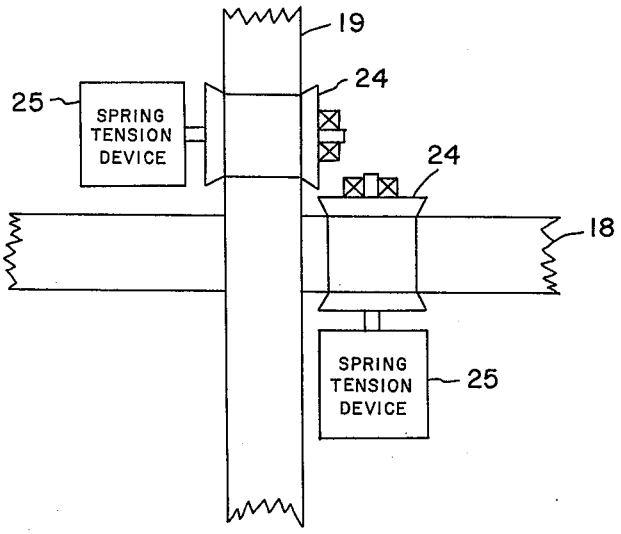
FIG. 4 is a plan view of the spring tension device area of FIGS. 1 and 2.

Spring take up arrangement shown in greater detail in FIG. 4 includes spring tension roller 24 and spring tension device 25 serve to keep a constant average tension on each of tapes 18 and 19 over the entire range of motion. The total length of each tape actually varies by a small amount because of geometrical constraints, but the spring tension devices 25 take up the slack. The two ends of a tape 18 or 19 is secured to its associated one of spring tension rollers 24.

Motion between antenna structure 8 and intermediate structure 3 is controlled by means of two additional metal flexible perforated tapes. One of these tapes, tape 26 is shown in the plane of FIGS. 1 and 2 while the other of these tapes is disposed in the plane oriented at 90° with respect to the plane of FIGS. 1 and 2. Operation of this motion is essentially identical to that described hereinabove for the motion of intermediate member 3 relative to column 2. As in this previous motion, identical tape rollers 22 on intermediate member 4 and identical tape rollers 23 on antenna structure 8, acting in conjunction with the ball joint including socket 12 and ball 13 serve to convert the U-axis and V-axis drive motions to an angular displacement between antenna structure 8 and intermediate structure 3. Tape 26 is driven by toothed roller 27 and an identical spring take up arrangement is also incorporated with tape 26. The scaling of the relative roller positions may be different for the upper motion than that for the lower motion if desired. In FIGS. 1 and 2 this scaling is shown as 2:3.

Figure 6:
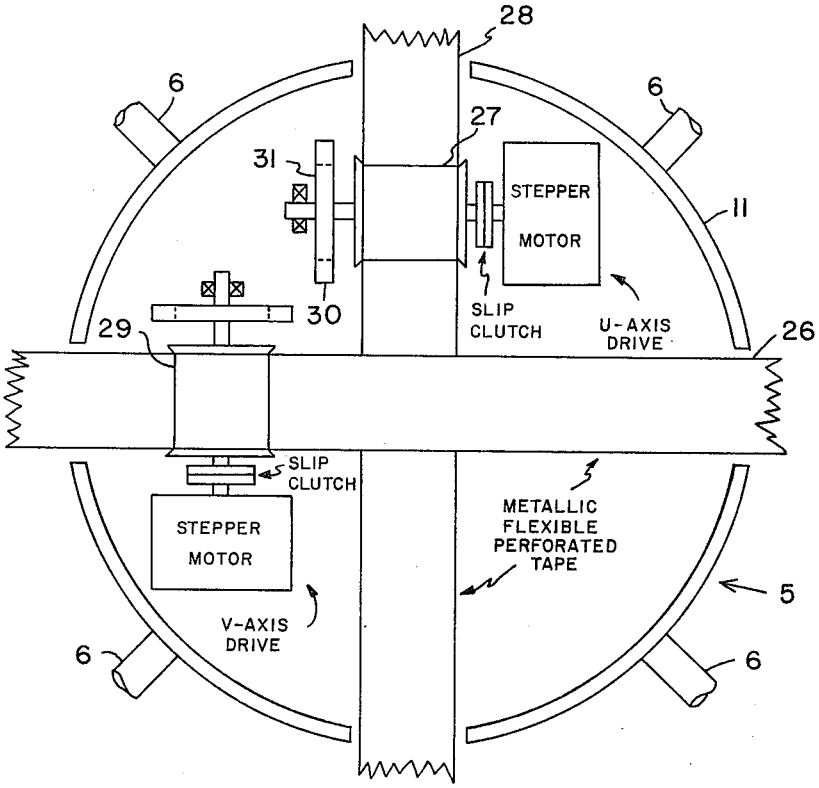
FIG. 6 is a top plan view of the drive mechanism of FIGS. 1 and 2.
Figure 7:
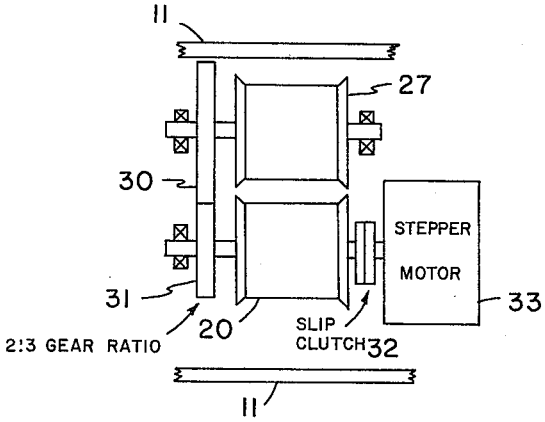
FIG. 7 is an elevational view of the U-drive mechanism of FIG. 6.

The U tape motions for the upper and lower portions are driven in synchronism such that the angular displacements are the same for the upper and lower drives. The same applies for the V tape motions. This is shown in greater detail in FIGS. 6 and 7. The drive to the upper roller, such as roller 27 of the U-axis drive is provided by a gear 30 which is meshed with gear 31 which is driven by lower roller 20 which in turn is driven by slip clutch 32 and stepper motor 33. The V-axis drive is provided by a similar arrangement.

FIG. 8 illustrates in greater detail the structure of rollers 23. Rollers 23 includes a Y-shaped member 34 rotatably secured to support structure 35. The axis 36 of the roller 37 is rotatably received in the bifurcated ends of member 34. The ability for relative motion of roller 37 with respect to support structure 35 provides the extra degree of freedom discussed above so that the tape fully engages the roller at all times.

Rollers 22 include a support structure 38 having therein rollers 39, 40 and 41 engaging member 42 to which roller 43 is rotatably secured. The ability for relative motion of roller 43 with respect to support structure 34 provides the extra degree of freedom discussed above so that the tape fully engages the roller at all times. Stop surfaces 44 – 47 limit the relative motion of roller 43 with respect to support structure 38.

The roller 23 of FIG. 8 cannot be used in place of roller 22 of FIG. 9, because the support structure would interfere with the tape for some conditions.

In terms of the usual definitions of azimuth angle A and elevation angle E, an approximate relationship to the drive angles U and V for the antenna mount of the present invention is given by:

$$U = \sin(45° - E/2)\cos A$$

$$V = \sin(45° - E/2)\sin A$$

For this antenna mount, the alignment between the U and V motions and fixed orientations on the antenna feed (such as would be established by a monopulse difference sensor or feed scanning means) is excellent with a minimum of cross coupling between axes. Therefore, the tracking circuits (utilizing step scan, monopulse difference, conical scan, or electronic scan) can be extremely simple with no requirement for cross coupling compensations. The only major non-linearity is a scale change (comparable to a variable gear ratio) which varies as $$[\cos(45° - E/2)]$$

For E varying from 0° to 90°, this represents a scale change of $\sqrt{2}$ to 1. For many applications, this variation can be easily tolerated with no compensating means. For more restrictive applications, an automatic gain control circuit can be provided in the tracking loop.

The tracking antenna mount of the present invention is applicable to any tracking system where complete hemispherical coverage is required, where the shock and vibration encironment is not too severe, and where angular position readouts of the line of sight are not required to great accuracy.

The tracking antenna mount of the present invention would have its greatest use for land-based communication systems, either to a satellite or to a drone aircraft, where the primary objective is to maximize the signal either way along the communication link, and determination of the direction of the line of sight with respect to some Earth based coordiante system is of little importance.

While I have described above the principles of my invention in connection with specific apparatus it is to be clearly understood that this description is made only by way of example and not as a limitation to the scope of my invention as set forth in the objects thereof and in the accompanying claims.

I claim:

1. A tracking antenna mount with complete hemispherical coverage comprising a base;

a first column secured to and extending vertically upward from said base, said first column having a first socket on an end thereof remote from said base;

an intermediate structure having first and second balls extending therefrom in opposite directions along a common axis, said first ball rotatably engaging said first socket;

a second column having a second socket on one end thereof, said second ball rotatably engaging said second socket;

an antenna structure secured to the other end of said second column; and drive means coupled to said intermediate member, said base, said first and second columns and said antenna structure to provide said complete hemispherical coverage by said antenna structure.

2. An antenna mount according to claim 1, wherein said drive means includes a plurality of metallic flexible perforated tapes.

3. An antenna mount according to claim 1, further including anchor means for flexible cables and flexible waveguides secured to the periphery of said intermediate structure to prevent tangling and snarling thereof, said cables and said waveguides providing electrical connections between said base and said antenna structure.

4. An antenna mount according to claim 1, wherein said drive means includes a first pair of metallic flexible perforated tapes disposed parallel to a first plane having a given orientation, and a second pair of metallic flexible perforated tapes disposed parallel to a second plane having an orientation at right angles to said given orientation.

5. An antenna mount according to claim 4, wherein one of said first pair of tapes is coupled to said intermediate structure, said antenna structure and said second column, the other of said first pair of tapes is coupled to said intermediate structure, said base and said first column, one of said second pair of tapes is coupled to said intermediate structures, said antenna structure and said second column, and the other of said second pair of tapes is coupled to said intermediate structure, said base and said first column.

6. An antenna mount according to claim 5, further including a first toothed roller disposed in said intermediate structure to engage and drive said one of said first pair of tapes, a second toothed roller disposed in said intermediate structure to engage and drive said other of said first pair of tapes, a third toothed roller disposed in said intermediate structure to engate and drive said one of said second pair of tapes, and a fourth toothed roller disposed in said intermediate structure to engage and drive said other of said second pair of tapes.

7. An antenna mount according to claim 6, further including a first drive mechanism disposed in said intermediate structure to drive both said first and second toothed roller, and a second drive mechanism disposed in said intermediate structure to drive both said third and fourth toothed roller.

8. An antenna mount according to claim 7, wherein said first drive mechanism includes a first stepper motor, a first slip clutch coupled between said first motor and one end of said first toothed roller, a first gear coupled to the other end of said first toothed roller, and a second gear coupled to the adjacent end of said second toothed roller and meshed with said first gear; and said second drive mechanism includes a second stepper motor, a second slip clutch coupled between said second motor and one end of said third toothed roller, a third gear coupled to the other end of said third toothed roller, and a fourth gear coupled to the adjacent end of said fourth toothed roller and meshed with said third gear.

9. An antenna mount according to claim 8, wherein said first and second gears have a predetermined gear ratio, and said third and fourth gears have said predetermined gear ratio.

10. An antenna mount according to claim 8, wherein said drive means further includes a first tape roller extending downward from said antenna structure spaced from one side of said second column parallel to said first plane, said first roller engaging said one of said first pair of tapes, a second tape roller extending downward from said antenna structure spaced from the other side of said second column parallel to said first plane, said second roller engaging said one of said first pair of tapes, a third tape roller extending upward from said intermediate structure adjacent the periphery on one side thereof parallel to said first plane, said third roller engaging said one of said first pair of tapes, a fourth tape roller extending upward from said intermediate structure adjacent the periphery thereof diametrically opposite said third roller parallel to said first plane, said fourth roller engaging said one of said first pair of tapes, a first spring tension means mounted on said second column parallel to said first plane and connected to both ends of said one of said first pair of tapes, a fifth tape roller extending downward from said intermediate structure adjacent said third roller parallel to said first plane, said fifth roller engaging said other of said first pair of tapes, a sixth tape roller extending downward from said intermediate structure adjacent said fourth roller parallel to said first plane, said sixth roller engaging said other of said first pair of tapes, a seventh tape roller mounted on said base spaced from one side of said first column parallel to said first plane, said seventh roller engaging said other of said first pair of tapes, an eighth tape roller mounted on said base spaced from the other side of said first column parallel to said first plane, said eighth roller engaging said other of said first pair of tapes, a second spring tension means mounted on said first column parallel to said first plane and connected to both ends of said other of said first pair of tapes, a ninth tape roller extending downward from said antenna structure spaced from one side of said second column parallel to said second plane, said ninth roller engaging said one of said second pair of tapes, a tenth tape roller extending downward from said antenna structure spaced from the other side of said second column parallel to said second plane, said tenth roller engaging said one of said second pair of tapes, an eleventh tape roller extending upward from said intermediate structure adjacent the periphery on one side thereof parallel to said second plane, said eleventh roller engaging said one of said second pair of tapes, a twelfth tape roller extending upward from said intermediate structure adjacent the periphery thereof diametrically opposite said eleventh roller parallel to said second plane, said twelfth roller engaging said one of said second pair of tapes, a third spring tension means mounted on said second column parallel to said second plane and connected to both ends of said one of said second pair of tapes, a thirteenth tape roller extending downward from said intermediate structure adjacent said eleventh roller parallel to said second plane, said thirteenth roller engaging said other of said second pair of tapes, a fourteenth tape roller extending downward from said intermediate structure adjacent said twelfth roller parallel to said second plane, said fourteenth roller engaging said other of said second pair of tapes, a fifteenth tape roller mounted on said base spaced from one side of said first column parallel to said second plane, said fifteenth roller engaging said other of said second pair of tapes, a sixteenth tape roller mounted on said base spaced from the other side of said first column parallel to said second plane, said sixteenth roller engaging said other of said second pair of tapes, a fourth spring tension means mounted on said first column parallel to said second plane and connected to both ends of said other of said second pair of tapes.

11. An antenna mount according to claim 5, wherein said drive means further includes a first tape roller extending downward from said antenna structure spaced from one side of said second column parallel to said first plane, said first roller engaging said one of said first pair of tapes, a second tape roller extending downward from said antenna structure spaced from the other side of said second column parallel to said first plane, said second roller engaging said one of said first pair of tapes, a third tape roller extending upward from said intermediate structure adjacent the periphery on one side thereof parallel to said first plane, said third roller engaging said one of said first pair of tapes, a fourth tape roller extending upward from said intermediate structure adjacent the periphery thereof diametrically opposite said third roller parallel to said first plane, said fourth roller engaging said one of said first pair of tapes, a first spring tension means mounted on said second column parallel to said first plane and connected to both ends of said one of said first pair of tapes, a fifth tape roller extending downward from said intermediate structure adjacent said third roller parallel to said first plane, said fifth roller engaging said other of said first pair of tapes, a sixth tape roller extending downward from said intermediate structure adjacent said fourth roller parallel to said first plane, said sixth roller engaging said other of said first pair of tapes, a seventh tape roller mounted on said base spaced from one side of said first column parallel to said first plane, said seventh roller engaging said other of said first pair of tapes, an eighth tape roller mounted on said base spaced from the other side of said first column parallel to said first plane, said eighth roller engaging said other of said first pair of tapes, a second spring tension means mounted on said first column parallel to said first plane and connected to both ends of said other of said first pair of tapes, a ninth tape roller extending downward from said antenna structure spaced from one side of said second column parallel to said second plane, said ninth roller engaging said one of said second pair of tapes, a tenth tape roller extending downward from said antenna structure spaced from the other side of said second column parallel to said second plane, said tenth roller engaging said one of said second pair of tapes, an eleventh tape roller extending upward from said intermediate structure adjacent the periphery on one side thereof parallel to said second plane, said eleventh roller engaging said one of said second pair of tapes, a twelfth tape roller extending upward from said intermediate structure adjacent the periphery thereof diametrically opposite said eleventh roller parallel to said second plane, said twelfth roller engaging said one of said second pair of tapes, a third spring tension means mounted on said second column parallel to said second plane and connected to both ends of said one of said second pair of tapes, a thirteenth tape roller extending downward from said intermediate structure adjacent said eleventh roller parallel to said second plane, said thirteenth roller engaging said other of said second pair of tapes, a fourteenth tape roller extending downward from said intermediate structure adjacent said twelfth roller parallel to said second plane, said fourteenth roller engaging said other of said second pair of tapes, a fifteenth tape roller mounted on said base spaced from one side of said first column parallel to said second plane, said fifteenth roller engaging said other of said second pair of tapes, a sixteenth tape roller mounted on said base spaced from the other side of said first column parallel to said second plane, said sixteenth roller engaging said other of said second pair of tapes, a fourth spring tension means mounted on said first column parallel to said second plane and connected to both ends of said other of said second pair of tapes.

* * * * *